US008365454B2

(12) United States Patent
Hogan, Jr.

(10) Patent No.: US 8,365,454 B2
(45) Date of Patent: Feb. 5, 2013

(54) INCREASED CAPACITY AMMUNITION CLIP

(76) Inventor: R. Russell Hogan, Jr., Pacific, MO (US)

( * ) Notice: Subject to any disclaimer, the term of this patent is extended or adjusted under 35 U.S.C. 154(b) by 76 days.

(21) Appl. No.: 13/006,590

(22) Filed: Jan. 14, 2011

(65) Prior Publication Data

US 2011/0173857 A1 Jul. 21, 2011

Related U.S. Application Data

(60) Provisional application No. 61/295,443, filed on Jan. 15, 2010.

(51) Int. Cl.
*F41A 9/65* (2006.01)

(52) U.S. Cl. ..... 42/50

(58) Field of Classification Search ..... 42/50, 18, 42/22

See application file for complete search history.

(56) References Cited

U.S. PATENT DOCUMENTS

| | | | | |
|---|---|---|---|---|
| 2,217,848 | A | 10/1940 | Schillstrom | |
| 3,226,869 | A | 1/1966 | Musgrave | |
| 3,603,020 | A | 9/1971 | Wiese | |
| 3,619,929 | A | 11/1971 | Fremont | |
| 3,726,038 | A | 4/1973 | Bredbury | |
| 3,977,114 | A | 8/1976 | Poor | |
| 4,139,959 | A | 2/1979 | Howard et al. | |
| 4,413,437 | A | 11/1983 | Anderson | |
| 4,428,137 | A | 1/1984 | Johnson | |
| 4,520,585 | A * | 6/1985 | Barrett | 42/7 |
| 4,586,281 | A | 5/1986 | Chesnut | |
| 4,589,218 | A | 5/1986 | Teppa | |
| 5,056,252 | A | 10/1991 | Velezis | |
| 5,782,157 | A * | 7/1998 | Ellington et al. | 89/33.16 |
| 6,070,352 | A | 6/2000 | Daigle | |
| 6,257,115 | B1 * | 7/2001 | Balsavage et al. | 89/33.1 |
| 7,533,483 | B1 * | 5/2009 | Alzamora et al. | 42/50 |

* cited by examiner

*Primary Examiner* — Michael David
(74) *Attorney, Agent, or Firm* — Armstrong Teasdale LLP

(57) ABSTRACT

An ammunition clip is described that includes a front end wall, a back end wall, two opposing sidewalls operably engaged with the front end wall and the back end wall to define an enclosure. The sidewalls each include a top section defining a first circumference for the enclosure, a lower section defining a second circumference for the enclosure that is larger than the first circumference, and a transition section between the top section and the lower section. The transition section includes a plurality of offset angled members opposite one another defining the transition between the top section and the lower section. A first guide extends inward into the enclosure from the front end wall substantially orthogonal thereto and a second guide extends inward into the enclosure from the back end wall substantially orthogonal thereto. A guided member is configured to travel within the enclosure in a substantially planar fashion and includes slots at each end thereof for engagement with respective said guides.

20 Claims, 8 Drawing Sheets

INCREASED CAPACITY AMMUNITION CLIP

CROSS-REFERENCE TO RELATED APPLICATIONS

This application claims the benefit of U.S. Provisional Patent Application Ser. No. 61/295,443, filed Jan. 15, 2010, the contents of which are hereby incorporated by reference in its entirety.

BACKGROUND

The field of the invention relates generally to weapon components, and more specifically to an increased capacity ammunition clip.

Ammunition clips for military style rifles are fairly consistent in their size, shape and capacity. One likely reason is in regard to weight and balance of the weapon. Another likely reason is practical. In a military situation, a rifle user in a prone position can only utilize a clip of a certain length before it affects their ability to use the weapon. For example, if the clip is too long, the clip will engage the ground or other surface and may not allow the user to probably aim and fire the weapon. Such considerations limit the capacity of such ammunition clips.

Another consideration is the functionality of the clip. A clip configuration must provide for the orderly progression of cartridges into (and out of) the weapon. As such, most ammunition clips incorporate a staggered stack of cartridges.

Finally, ammunition clips must be reliable. Other attempts have been made to increase clip capacity. Many of these increased capacity clips incorporate one or more mechanical features that have rendered such ammunition clips unreliable for their intended purpose.

BRIEF DESCRIPTION

In one aspect, an ammunition clip is provided that includes a front end wall, a back end wall, two opposing sidewalls operably engaged with the front end wall and the back end wall to define an enclosure. The sidewalls each include a top section defining a first circumference for the enclosure, a lower section defining a second circumference for the enclosure that is larger than the first circumference, and a transition section between the top section and the lower section. The transition section includes a plurality of offset angled members opposite one another defining the transition between the top section and the lower section. A first guide extends inward into the enclosure from the front end wall substantially orthogonal thereto and a second guide extends inward into the enclosure from the back end wall substantially orthogonal thereto. A guided member is configured to travel within the enclosure in a substantially planar fashion and includes slots at each end thereof for engagement with respective said guides.

In another aspect, an ammunition clip is provided that includes a front member having a longitudinal axis, a back member having a longitudinal axis, two opposing sidewall members operably engaged with the front member and the back member to define an enclosure, a first guide attached in a substantially orthogonal configuration to the front end wall and extending inward into the enclosure from the front end wall, the first guide substantially parallel to the longitudinal axis, a second guide attached in a substantially orthogonal configuration to the back end wall and extending inward into the enclosure from the back end wall, the first guide substantially parallel to the longitudinal axis, and a guided member configured for movement within the enclosure. The guided member includes slots formed therein at opposite ends thereof for engagement with respective guides.

The features, functions, and advantages that have been discussed can be achieved independently in various embodiments of the present invention or may be combined in yet other embodiments further details of which can be seen with reference to the following description and drawings.

DETAILED DESCRIPTION

Figure 1:
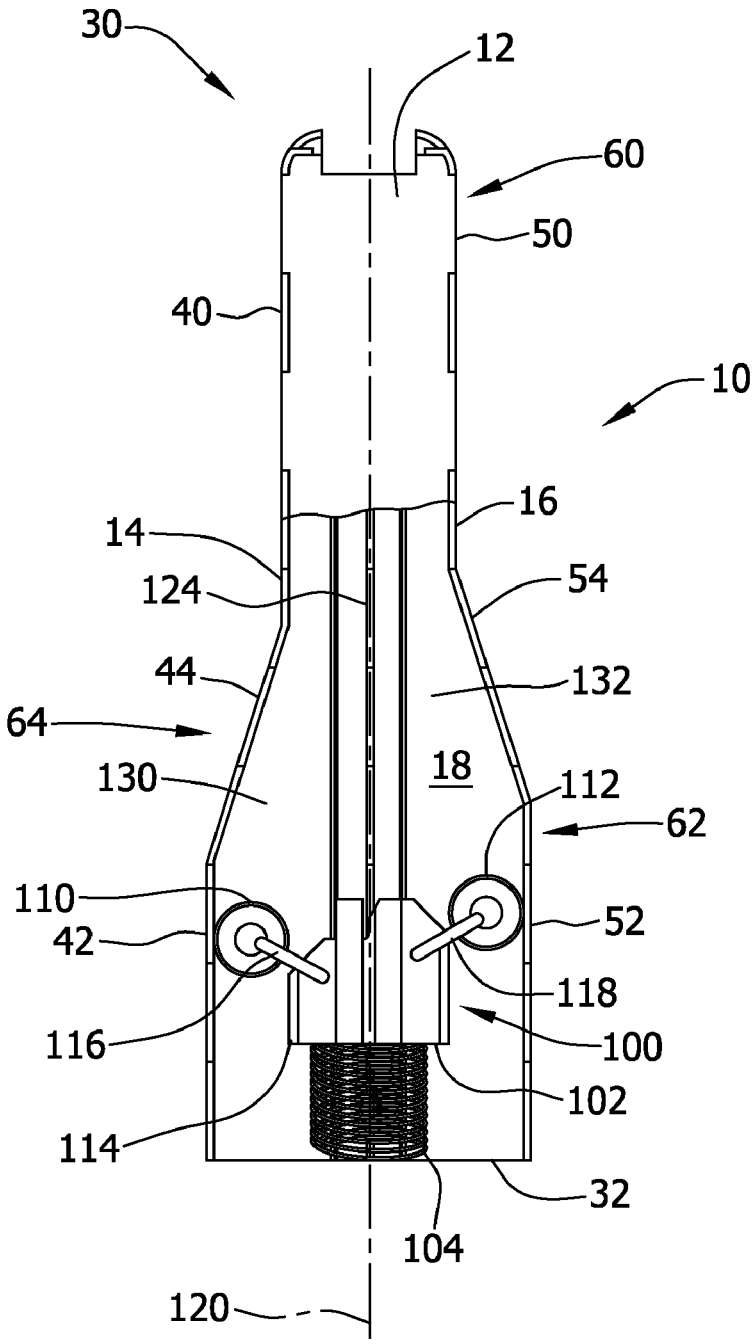
FIG. 1 is back cutaway view of one embodiment of an increased capacity ammunition clip.

FIG. 1 is back cutaway view of one embodiment of an increased capacity ammunition clip 10. Clip 10 includes a front wall 12, side walls 14 and 16, and a back wall 18. A top 30 of clip 10 is configured for engagement with a weapon as is well known in the art. A bottom wall 32 engages front wall 12, side walls 14 and 16, and the back wall 18 and may be utilized, at least in part, to maintain a position of front wall 12, side walls 14 and 16, and back wall 18 with respect to one another.

The edges of front wall 12, side walls 14 and 16, and back wall 18 may be configured with any number of mechanical features that allow for the assembly of these components. For example, the walls may be configured with interdigitated teeth which then define slots. Respective teeth and slots may engage one another on adjacent components for assembly of clip 10. Further, the teeth may be bent at an angle to complete assembly of clip 10. In alternative embodiments the front wall 12, side walls 14 and 16, and back wall 18, as well as bottom wall 32 may be welded together, with or without the tooth and slot assembly described above. As those skilled in the art will realize, there are many methods that can be utilized to join such components together. Further, such components may be fabricated from a metal, a composite, a plastic, or a combination thereof. Fabrication methods and component attachment methods for such materials are well known.

Side wall 14 includes a top member 40, a bottom member 42 and an angled member 44. Side wall 16 includes a top member 50, a bottom member 52 and an angled member 54. As shown in the drawing, bottom member 52 is longer than bottom member 42 which results in angled members 44 and 54 being offset from one another, which provides a functionality that is further described in the following paragraphs. Correspondingly, top member 40 is longer than top member 50.

Top members 40 and 50, along with upper portions of the front wall 12 and back wall 18 define a top section 60, and bottom members 42 and 52, along with lower portions of the front wall 12 and back wall 18 define a lower section 62 of clip 10. Offset angled members 44 and 54, along with corresponding portions of the front wall 12 and back wall 18 define a transition section 64 of clip 10. As is easily understood from FIG. 1, lower section 62 of clip 10 has a larger circumference than does upper section 60. In the illustrated embodiment, the top section 60 is sized such that two somewhat overlapping rows of cartridges may be disposed therein. In contrast, the bottom section 62 is sized such that two separate columns of two somewhat overlapping rows of cartridges may be disposed therein, which as is easily understood, is what provides the increased capacity over known ammunition clips. The following paragraphs describe the mechanical features of ammunition clip 10 that provide for the increased capacity as well as the necessary reliability when feeding cartridges into a magazine of a weapon.

Disposed within ammunition clip 10 is a follower assembly 100 which includes a bottom 102 that engages a mechanical spring 104 that is disposed between the bottom 102 and bottom wall 32. The follower assembly 100 includes two rollers 110 and 112, a guided member 114 and two swing arms 116 and 118 that attach the roller 110 and 112 to the guided member 114 in such a way that rollers 110 and 112 are free to rotate with respect to their respective swing arms 116 and 118, and free to move with respect to guided member 114 as constrained by the respective swing arms 116 and 118. In embodiment, rollers 110 and 112 are configured with a bore therethrough. Such bore has a diameter that is larger than an outside diameter of the respective swing arm 116 and 118. Such a configuration operates to help prevent binding of the roller on the respective swing arm, as well as creating a self cleaning effect.

In embodiments, guided member 114 includes mechanical features that engage mating features separately attached to one or both of the front wall 12 and the back wall 18, thereby causing guided member 114 to travel in a planar fashion up and down the ammunition clip 10 based on pressures exerted by spring 104 and an external pressure imparted from above. One such guide 124, associated with guided member 114 is shown as attached to back wall 18, is substantially parallel to center line 120, and is further described below. Guided member 114 includes dimensions and mechanical features such that a similar guide attached the front wall 12 and the guide 124 attached to the back wall 18, at least in part, maintain a position of guided member 114 so that it can only move in the plane defined by the center line 120.

In other embodiments, and as described further herein, inserts or guides may be attached to the front wall 12 and the back wall 18, for example in a perpendicular fashion which engage corresponding slots in the guided member 114. This configuration provides a mechanism, via the perpendicular guides, for maintaining separation between cartridges in the left half 130 and the right half 132 (as shown in the Figures) of the ammunition clip 10.

Figure 2:
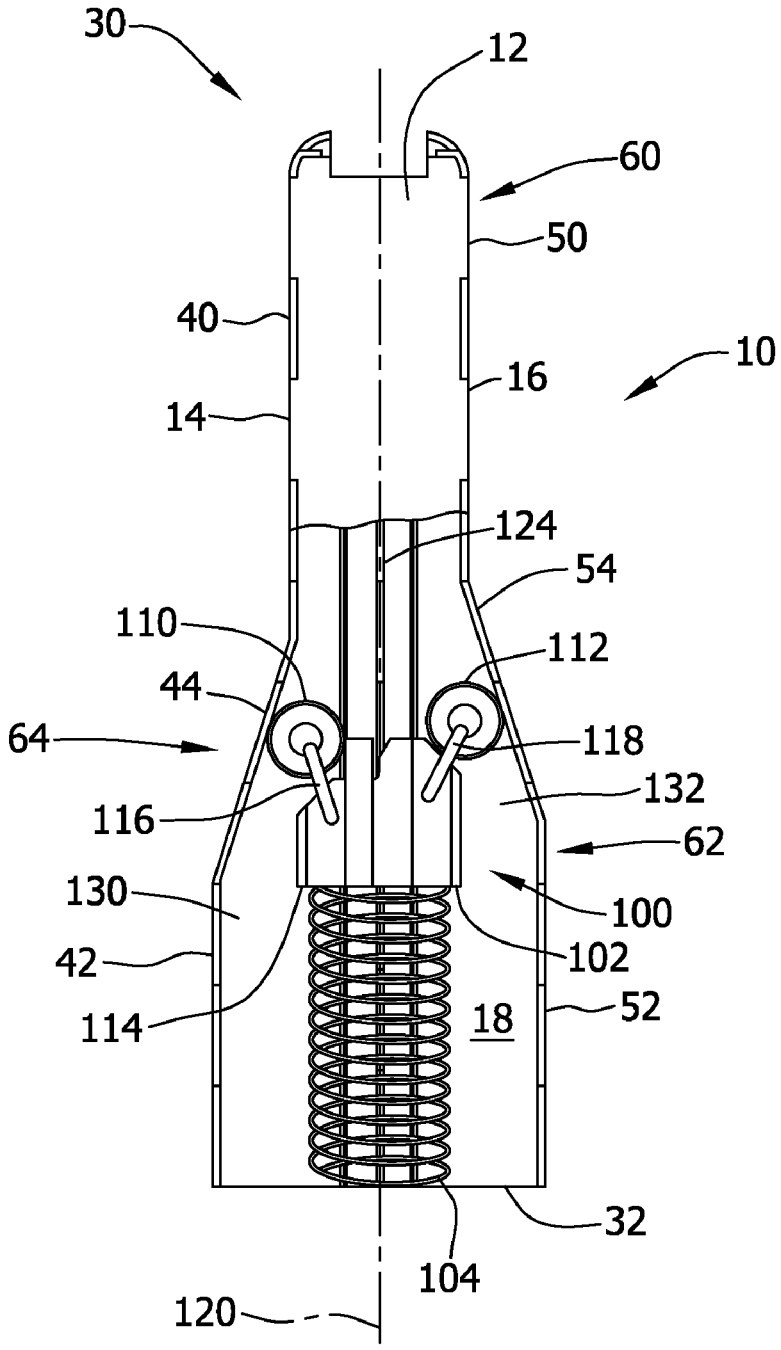
FIG. 2 illustrates the clip of FIG. 1 as rollers begin to engage offset angled members of the clip.
Figure 3:
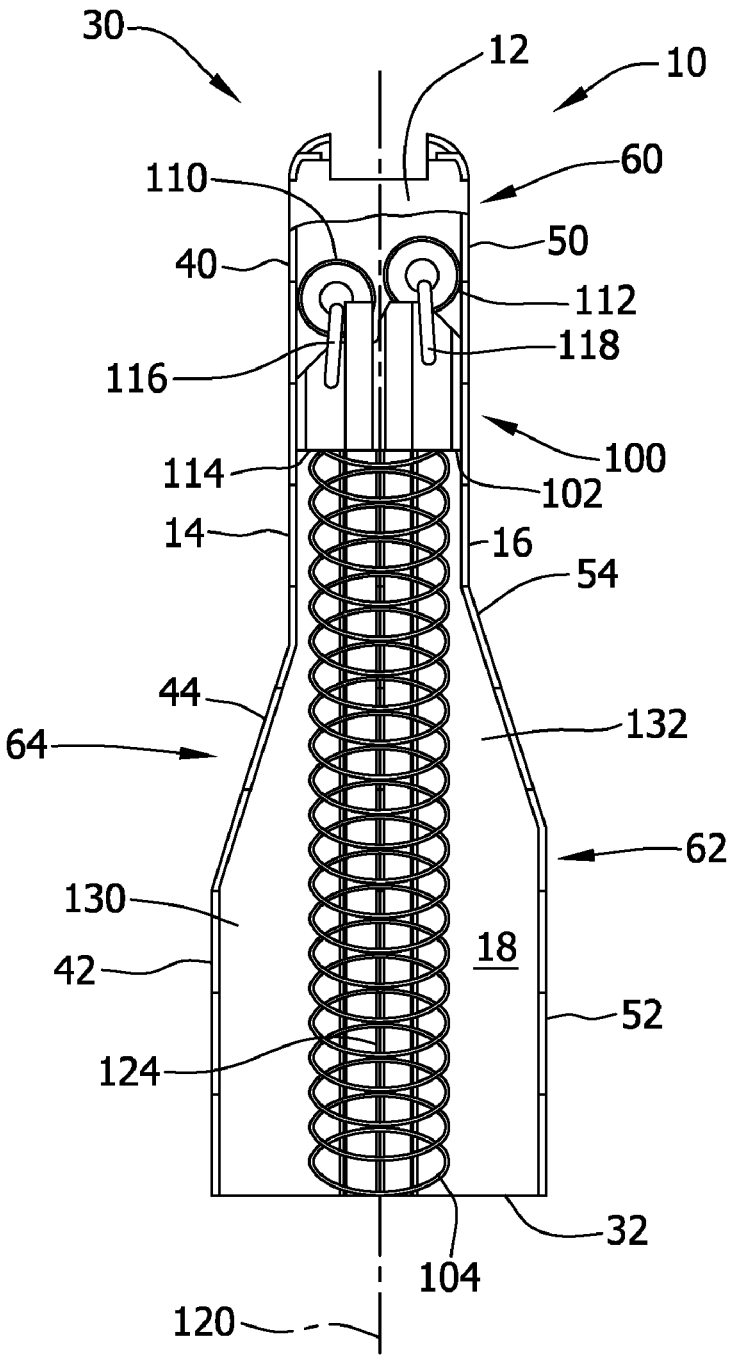
FIG. 3 illustrates the clip of FIG. 1 as rollers move into engagement with top members of the clip.

As shown in FIG. 1, gravity, and the mechanical linkage provided by swing arms 116 and 118 and guided member 114, tends to cause rollers 110 and 112 to "fall against" the inside surface of respective bottom members 42 and 52. It is noted that rollers 110 and 112 are staggered in height due to the shape of guided member 114 and/or the length of the respective swing arms 116 and 118. As seen in FIGS. 2 and 3, this staggering matches the staggering that one of ordinary skill will recognize as being consistent with the relative position of cartridges to one another in an ammunition clip.

Top section 30 may include features that cause cartridges to remain in position within ammunition clip 10 despite the pressure applied by mechanical spring 104. Such features are well known and are common to most, if not all, ammunition clips and the action operates to extract one cartridge at a time from the ammunition clip 10. Referring specifically now to FIG. 2, as cartridges are extracted from ammunition clip 10, the force applied by mechanical spring 104 pushes the follower assembly 100 upward, to the point where rollers 110 and 112 begin to engage the offset angled members 44 and 54. Continuing with FIG. 3, as additional cartridges are expended, spring 104 causes rollers 110 and 112 move up the respective angled members 44 and 54 and into engagement with top members 40 and 50. Operation of guided member 114, rollers 110 and 112, and side walls 14 and 16, as well as the separation provided by guide 124 and guide 126 (shown in FIG. 8), allow for the orderly combination of two separate columns of staggered cartridges into a single column of staggered cartridges.

It should be noted in FIG. 3 that the rollers 110 and 112 are staggered with respect to one another, and are positioned in a similar fashion with respect to one another as are cartridges when deployed within the upper section of the ammunition clip 10. In embodiments, mechanical spring 104 is somewhat conical in shape, which allows for coils in the portion of the spring with a lesser diameter to collapse into the portion of the spring with a greater diameter. This embodiment keeps the spring from "bottoming out" coil to coil. Such a configuration reduces the "solid height" of the spring when compressed, which allows the guided member 114 to travel further into the magazine, also increasing capacity over embodiments that incorporate a cylindrical spring that has an increased solid height.

Figure 4:
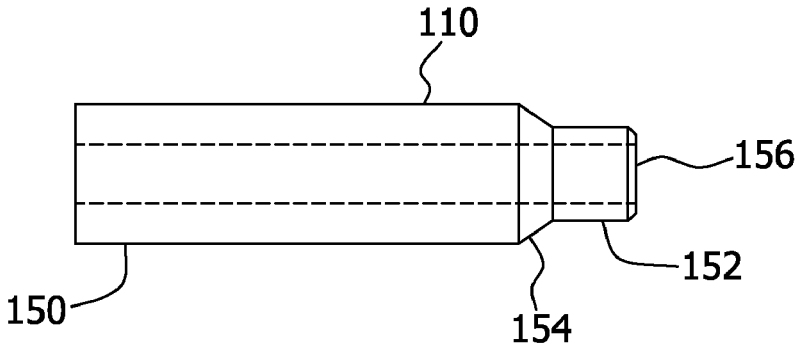
FIG. 4 is a side view of one embodiment of roller.
Figure 5:
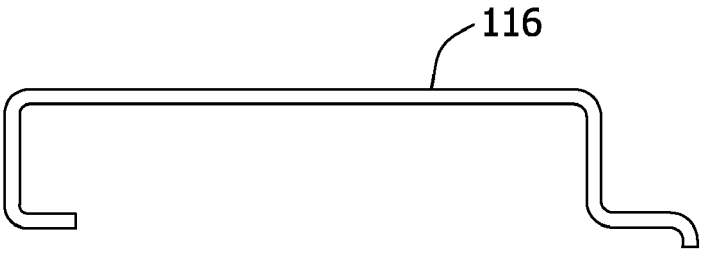
FIG. 5 is a side view of one embodiment of a swing arm.

FIG. 4 is a side view of one embodiment of roller 110. In embodiments, roller 110 and roller 112 are of the same configuration. Roller 110 includes a large diameter section 150, a small diameter section 152 with a chamfered section 154 extending therebetween such that roller 110 has the same general shape as an expended cartridge (without the projectile extending therefrom). This shape helps in the interaction between the rollers 110 and 112 and adjacent cartridges when the ammunition clip is loaded and when a weapon that has clip 10 engaged is being utilized. A bore 156 extends through roller 110 for the insertion of swing arm 116 therethrough. FIG. 5 is a side view of one embodiment of a swing arm 116.

Figure 6:
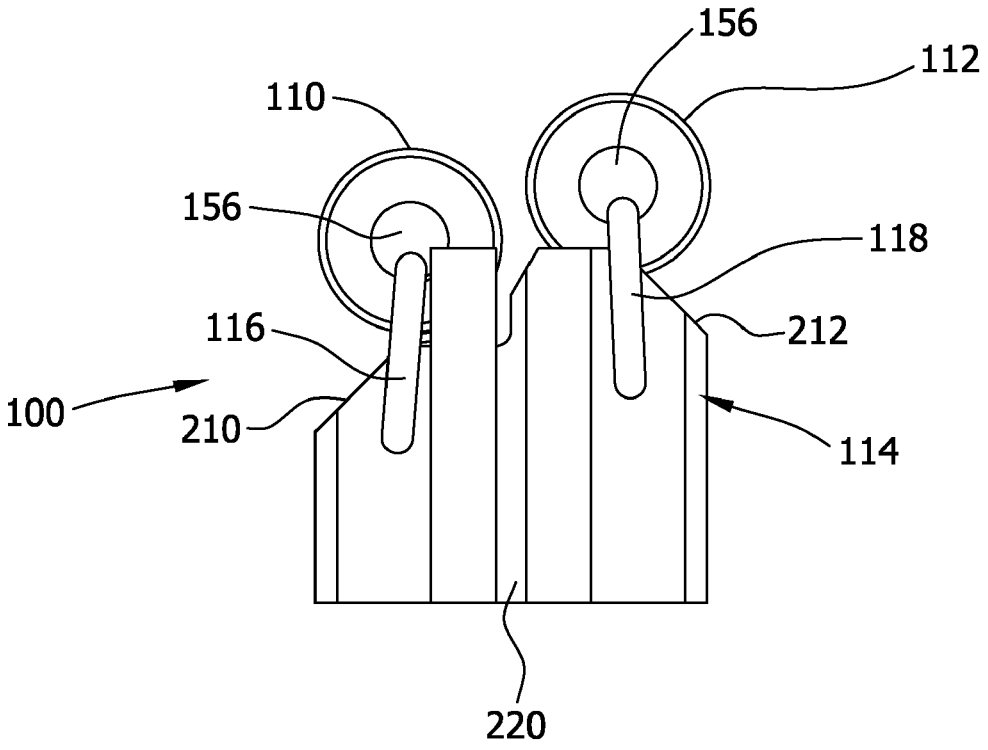
FIG. 6 is an end view of one embodiment of a follower assembly.
Figure 7:
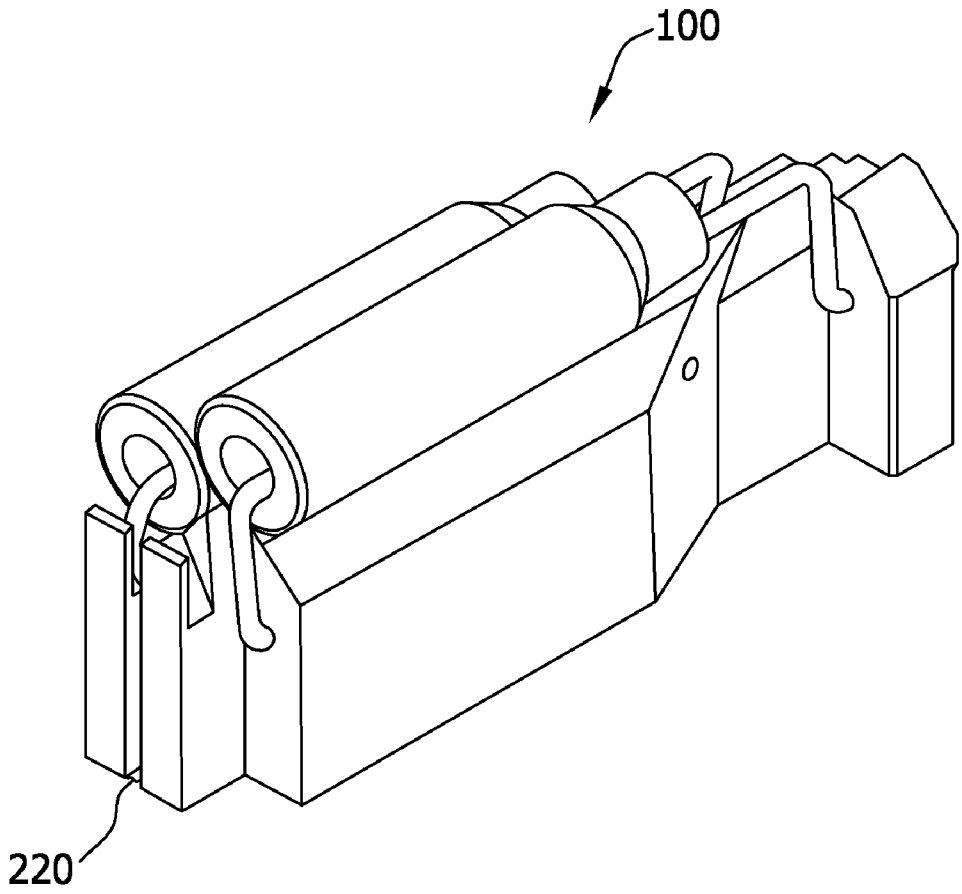
FIG. 7 is a perspective view of the follower assembly of FIG. 6.

FIG. 6 is an end view of one embodiment of follower assembly 100. In one aspect, FIG. 6 serves to illustrate a shape of one exemplary embodiment of guided member 114. Rollers 110 and 112 as well as swing arms 116 and 118 are illustrated. In the illustrated embodiment, guided member 114 includes inclined surfaces 210 and 212 which are useful during the transitions of rollers 110 in rolling from a first position, such as shown in FIG. 1, to a second position, such as shown in FIG. 3. Specifically, as the overall shape of clip 10 transitions from the dimensions of the lower section 62 to the dimensions of the top section 60 (both shown in FIG. 1), the rollers 110 and 112 will tend to move along the respective inclined surfaces 210 and 212 until they attain the position shown in FIGS. 3 and 6. Conversely, as the clip 10 is loaded with ammunition, the rollers 110 and 112 will eventually be caused to move along the respective inclined surfaces 210 and 212 until they attain the position shown in FIG. 1. Guided member 114 includes a vertical slot 220 formed in an end thereof which is configured to engage a mating guide such as guide 124 formed integral with or attached to as well as substantially perpendicular to the front wall 12 or the back wall 18. FIG. 7 is a perspective view of one embodiment of follower assembly 100 further illustrating slot 220.

Figure 8:
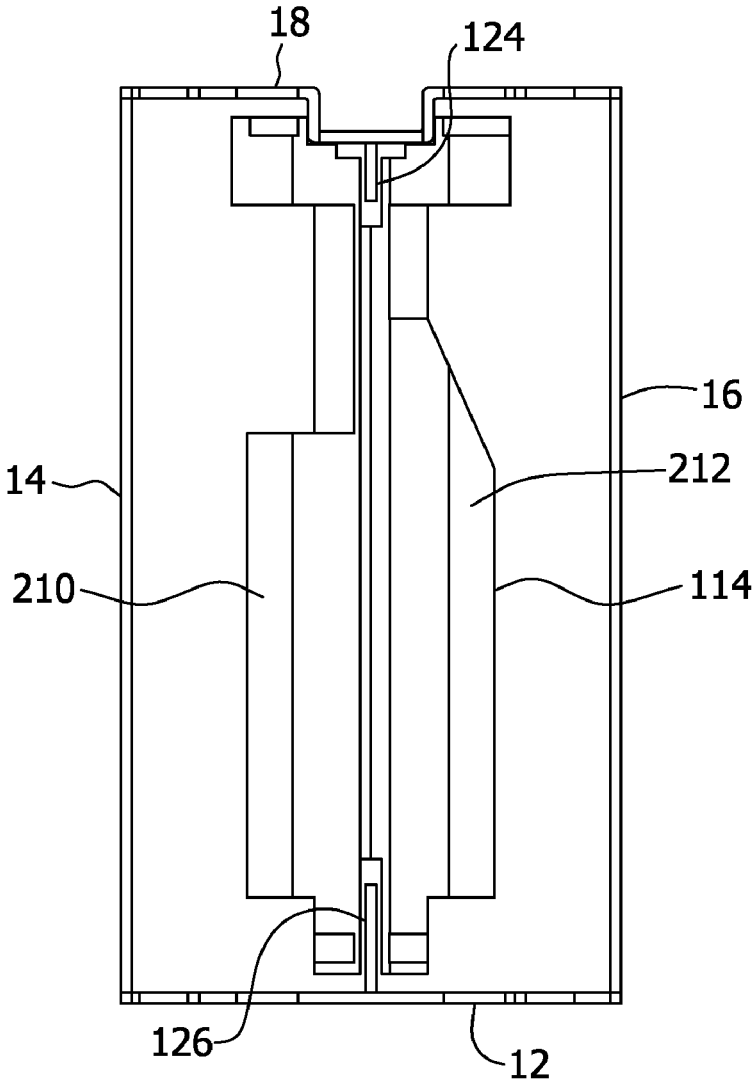
FIG. 8 a top view of the ammunition clip illustrating the guiding of the follower assembly.

FIG. 8 is a top view of the bottom portion of clip 10 illustrating the positioning of front wall 12, side walls 14 and 16, and back wall 18 with respect to one another. Further, FIG. 8 illustrates the attachment of guides 124 and 126 to the back wall 18 and the front wall 112 respectively. Finally, FIG. 8 illustrates the guided member 114 and the engagement of the guides 124 and 126 thereto. Guided member 114 has a number of mechanical features formed therein that allows foreign objects to pass between the guided member 114 and a respective sidewall when the guided member 114 is proximate the top section of the side walls. In one embodiment, the various sections of the opposing sidewalls include at least one indentation formed therein that provide a point of contact between the sidewalls 14 and 16 and the guided member 114. These indentations, together with guides 124 and 126, operate to prevent the guided member 114 from tilting front to back as well as from side to side. Such tilting is common in known ammunition magazines.

Figure 9:
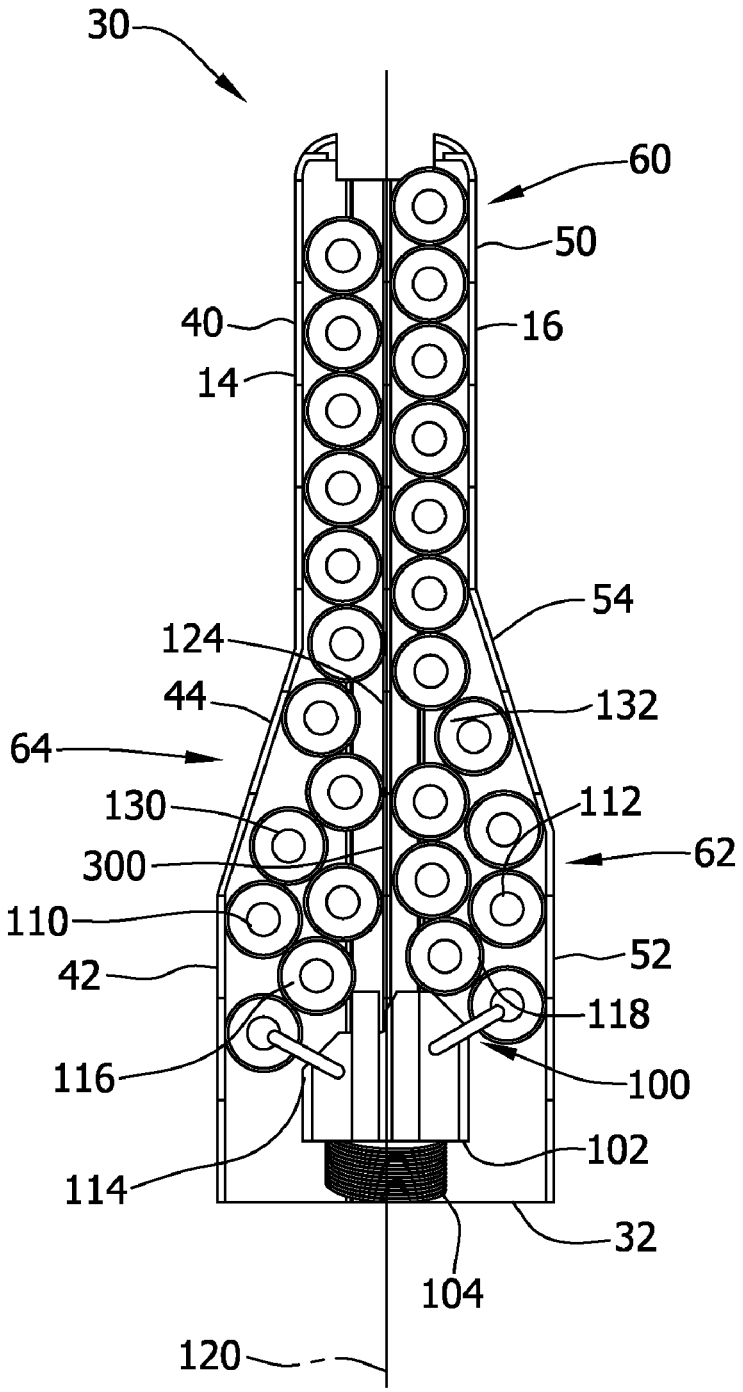
FIG. 9 is an end view of ammunition clip when loaded with cartridges.

FIG. 9 is an end view of ammunition clip 10 when loaded with cartridges and further illustrating the operation of an insert 300 that is attached to the front wall 12. An insert attached to the back wall operates similarly and embodiments of ammunition clip 10 may incorporate one or both of such inserts. It should be noted that the components of clip 10 can be configured with various indentations and protrusions and the like which help in the reduction of friction between cartridges and the clip itself.

FIGS. 1, 2, and 3 illustrate the movement of rollers 110 and 112 as the guided member 114 moves up and down the ammunition clip 10. It should be noted that a mechanical linkage can be placed across swing arms 116 and 118 that limits the distance that the rollers 110 and 122 can move away from one another. Examples include, but are not limited to, cams that provide a stop or an adjustment to the movement of the swing arms 116 and 118. In other words, movement of swing arms 116 and 118 can be limited such that rollers 110 and 112 will not come into contact with bottom members 42 and 52. Such a feature is useful when utilizing ammunition clip 10 with a cartridge that is smaller in diameter than the diameter of cartridge originally intended for ammunition clip 10.

The above described embodiments provide an increased ammunition capacity for rifles, pistols and specialized weapons and cartridges without requiring an increased length magazine which provides such benefits as described herein.

This written description uses examples to disclose various embodiments, which include the best mode, to enable any person skilled in the art to practice those embodiments, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An ammunition clip comprising:
a front end wall;
a back end wall;
two opposing sidewalls operably engaged with said front end wall and said back end wall to define an enclosure, said sidewalls comprising:
a top section defining a first circumference for the enclosure;
a lower section defining a second circumference for the enclosure that is larger than the first circumference; and
a transition section between said top section and said lower section, said transition section comprising a plurality of offset angled members opposite one another defining the transition between said top section and said lower section; and
a first guide extending inward into the enclosure from said front end wall substantially orthogonal to said front end wall;
a second guide extending inward into the enclosure from said back end wall substantially orthogonal to said back end wall; and
a guided member configured to travel within the enclosure in a substantially planar fashion, said guided member comprising slots at each end thereof for engagement with respective said guides.

2. The ammunition clip according to claim 1 further comprising:
a first roller; and
a second roller, said rollers operatively attached to said guided member such that respective said rollers are in contact with respective said sidewalls as said guided member travels within the enclosure.

3. The ammunition clip according to claim 2 further comprising:
a first swing arm; and
a second swing arm, said swing arms movably engaged with said guided member, respective said rollers rotatably engaged with respective said swing arms to allow respective said rollers to engage respective said sidewalls.

4. The ammunition clip according to claim 2 wherein at least one of said first guide and said second guide operate to maintain a position of each said roller between said at least one guide and a respective said side wall.

5. The ammunition clip according to claim 1 further comprising:
a bottom plate attached to said front end wall, said side walls, and said back end wall; and
a spring disposed between said bottom plate and a bottom of said guided member biasing said guided member towards a top of said clip.

6. The ammunition clip according to claim 1 wherein said guided member comprises at least one mechanical feature formed therein that allows foreign objects to pass between the guided member and a respective said sidewall when said guided member is proximate said top section of said sidewalls.

7. The ammunition clip according to claim 1 wherein said top sections of said opposing sidewalls comprise at least one indentation therein, said indentations providing a point of contact between said sidewalls and said guided member.

8. The ammunition clip according to claim 1 further comprising:
a first roller; and
a second roller, said rollers operatively attached to said guided member such that respective said rollers are in contact with respective said sidewalls as said guided member travels within the enclosure, said transition sections of said sidewalls offset from one another such that said rollers are offset from one another in height as said guided member travels within the enclosure.

9. The ammunition clip according to claim 1 further comprising:
a first roller;
a second roller;
a first swing arm; and a second swing arm, said swing arms movably engaged with said guided member, respective said rollers rotatably engaged with respective said swing arms to allow respective said rollers to engage respective said sidewalls, said first arm having a first length, said second swing arm having a second length different than the first length such that said rollers are offset in height from one another.

10. An ammunition clip comprising:

a front member having a longitudinal axis;

a back member having a longitudinal axis;

two opposing sidewall members operably engaged with said front member and said back member to define an enclosure;

a first guide attached in a substantially orthogonal configuration to said front end wall and extending inward into the enclosure from said front end wall, said first guide substantially parallel to the longitudinal axis;

a second guide attached in a substantially orthogonal configuration to said front end wall and extending inward into the enclosure from said back end wall, said second guide substantially parallel to the longitudinal axis; and a guided member configured for movement within the enclosure, said guided member comprising slots formed therein at opposite ends thereof for engagement with respective said guides.

11. The ammunition clip according to claim 10 wherein said sidewall members each comprise:

a top section;

a lower section; and a transition section between said top section and said lower section, said transition section comprising a plurality of angled members opposite one another defining the transition between said top section and said lower section such that said top section defines a first circumference for the enclosure and said bottom section defines a second circumference for the enclosure that is larger than the first circumference.

12. The ammunition clip according to claim 11 wherein said angled members are offset from one another in height.

13. The ammunition clip according to claim 11 further comprising:

a first roller; and a second roller, said rollers operatively attached to said guided member such that respective said rollers are to free to move along respective said sidewall members as said guided member travels within the enclosure.

14. The ammunition clip according to claim 13 further comprising:

a first swing arm; and a second swing arm, said swing arms movably engaged with said guided member, respective said rollers rotatably engaged with respective said swing arms.

15. The ammunition clip according to claim 14 wherein said first roller and said second roller comprise a bore therethrough through which the respective swing arms extend.

16. The ammunition clip according to claim 13 wherein at least one of said first guide and said second guide operate to maintain a position of each said roller between said at least one guide and a respective said side wall member.

17. The ammunition clip according to claim 13 wherein said first roller and said second roller are offset in height from one another with respect to at least one of the longitudinal axis of said front member and the longitudinal axis of said back member.

18. The ammunition clip according to claim 17 wherein said first arm has a first length extending between said guided member and said first roller, and said second swing arm has a second length extending between said guided member and said second roller that is different than the first length such that said rollers are offset in height from one another.

19. The ammunition clip according to claim 17 wherein said guided member comprises a first surface and a second surface, said surfaces offset from one another and substantially orthogonal to the longitudinal axis of said front member and the longitudinal axis of said back member such that said rollers are offset from one another.

20. The ammunition clip according to claim 10 further comprising:

a bottom plate attached to a plurality of said front member, said sidewall members, and said back member; and a spring disposed between said bottom plate and a bottom of said guided member biasing said guided member away from said bottom plate.

* * * * *